US008159487B2

(12) United States Patent
Kusama et al.

(10) Patent No.: US 8,159,487 B2
(45) Date of Patent: Apr. 17, 2012

(54) PLASMA DISPLAY DEVICE

(75) Inventors: Fumito Kusama, Osaka (JP); Masaaki Kuranuki, Kyoto (JP); Hironori Konno, Osaka (JP)

(73) Assignee: Panasonic Corporation, Osaka (JP)

( * ) Notice: Subject to any disclaimer, the term of this patent is extended or adjusted under 35 U.S.C. 154(b) by 554 days.

(21) Appl. No.: 12/376,859

(22) PCT Filed: Jul. 25, 2008

(86) PCT No.: PCT/JP2008/001984

§ 371 (c)(1),
(2), (4) Date: Feb. 9, 2009

(87) PCT Pub. No.: WO2009/019822

PCT Pub. Date: Feb. 12, 2009

(65) Prior Publication Data

US 2010/0164927 A1 Jul. 1, 2010

(30) Foreign Application Priority Data

Aug. 6, 2007 (JP) ..... 2007-203892
Aug. 6, 2007 (JP) ..... 2007-203893
Aug. 9, 2007 (JP) ..... 2007-207580

(51) Int. Cl.
*G09G 5/00* (2006.01)

(52) U.S. Cl. ..... 345/211; 345/60; 345/37; 345/41

(58) Field of Classification Search ..... 345/211, 345/60, 37, 41
See application file for complete search history.

(56) References Cited

U.S. PATENT DOCUMENTS

| | | | | |
|---|---|---|---|---|
| 6,195,072 | B1 * | 2/2001 | Iwami et al. | 345/67 |
| 7,471,264 | B2 * | 12/2008 | Inoue et al. | 345/60 |
| 2002/0186184 | A1 * | 12/2002 | Lim | 345/60 |
| 2004/0085262 | A1 * | 5/2004 | Lee | 345/41 |
| 2006/0038750 | A1 * | 2/2006 | Inoue et al. | 345/60 |
| 2009/0167740 | A1 * | 7/2009 | Hashimoto et al. | 345/208 |

FOREIGN PATENT DOCUMENTS

| | | | |
|---|---|---|---|
| EP | 1 587 051 | A2 | 10/2005 |
| JP | 2005-070787 | A | 3/2005 |
| JP | 2005-266460 | A | 9/2005 |
| JP | 2006-201735 | A | 8/2006 |
| WO | 2006-126314 | A1 | 11/2006 |

OTHER PUBLICATIONS

Supplementary European Search Report dated Jun. 29, 2010.
International Search Report for PCT/JP2008/001984.

* cited by examiner

*Primary Examiner* — Wayne Young
*Assistant Examiner* — Linh Nguyen
(74) *Attorney, Agent, or Firm* — Pearne & Gordon LLP

(57) ABSTRACT

A plasma display device includes a scan electrode drive circuit including a sustain pulse generating circuit, which includes an electric power recovery capacitor, a first recovery switch and a first recovery inductor connected in series so as to form an electric current passage in which an electric current is allowed to flow from the electric power recovery capacitor to a scan electrode, a second recovery switch and a second recovery inductor connected in series so as to form an electric current passage in which an electric current is allowed to flow from the scan electrode to the electric power recovery capacitor, a first damper capacitor connected to a node between a diode of the first recovery switch and the first recovery inductor, and a second damper capacitor connected to a node between a diode of the second recovery switch and the second recovery inductor.

8 Claims, 10 Drawing Sheets

PLASMA DISPLAY DEVICE

This application is a U.S. National Phase Application of PCT International Application PCT/JP2008/001984.

TECHNICAL FIELD

The present invention relates to a plasma display device that is an image display device using a plasma display panel.

BACKGROUND ART

An AC surface discharge panel as a typical plasma display panel (hereinafter, abbreviated as a "panel") includes a front panel and a rear panel disposed facing each other with a large number of discharge cells provided therebetween. The front panel has a plurality of display electrodes, each composed of a pair of scan electrode and sustain electrode, formed in parallel to each other on a glass front substrate. A dielectric layer and a protective layer are formed so as to cover the display electrode pairs. The rear panel includes a plurality of data electrodes formed in parallel on a rear glass substrate, a dielectric layer formed so as to cover the data electrodes, and further, a plurality of barrier ribs formed in parallel to the data electrodes on the dielectric layer. A phosphor layer is formed on the top surface of the dielectric layer and the side surface of the barrier ribs. The front panel and the rear panel are disposed facing each other so that the display electrodes three-dimensionally intersect with the data electrodes, and sealed to each other. The discharge space inside thereof is filled with a discharge gas. Herein, a discharge cell is formed in a portion where the display electrode and the data electrode face each other. In a panel having such a configuration, ultraviolet light is generated by gas discharge in each discharge cell, and this ultraviolet light excites a phosphor for each color of RGB to cause light emission for color display.

As a method for driving a panel, a subfield method is generally employed. The subfield method divides one field period into a plurality of subfields, and carries out gradation display by a combination of subfields to emit light. Each subfield includes an initializing period, an address period, and a sustain period. In the initializing period, an initializing voltage is applied to each electrode so as to form wall charge necessary for a subsequent address operation. In the address period, a scanning pulse is applied to the scan electrode, and an address pulse is applied to the data electrode, thus generating address discharge in a discharge cell to be displayed. In the sustain period, a sustain pulse is applied alternately to the scan electrode and the sustain electrode so as to cause sustain discharge in a discharge cell in which address discharge has been generated. Thus, a phosphor layer of the corresponding discharge cell is allowed to emit light so as to carry out an image display.

Thus, the plasma display device includes a drive circuit for each electrode to drive each electrode of the panel. These electrode drive circuits include a large number of switching elements. In particular, a scan electrode drive circuit for driving the scan electrode needs to generate complicated drive waveforms, and configured by combining an initializing voltage generating circuit, a sustain pulse generating circuit, a scan pulse generating circuit, and the like. In order to avoid interference between these circuits, a separation switch is provided between these circuits if necessary (see, for example, patent document 1).

However, when such a separation switch is provided in an electric current passage, the output impedance of the scan electrode drive circuit is increased, causing a large electric power loss accompanying sustain discharge. Furthermore, a large output impedance may be a factor for making discharge unstable, for example, the ringing is superimposed on the sustain pulse due to the resonance of the output impedance and the electrode capacitance and the like, or the value of the voltage drop by the output impedance is dependent upon the amount of electric current, so that a sustain pulse voltage applied to the discharge cell is also dependent upon the amount of electric current. Furthermore, since a high voltage is applied to such separation switches, the separation switch must be configured by using high breakdown voltage switching elements. Since the on-resistance of the high breakdown voltage switching element is high, it is necessary that a large number of switching elements are connected in parallel so as to reduce the output impedance.

In order to solve such problems, a novel scan electrode drive circuit capable of reducing the output impedance of the scan electrode drive circuit and reducing the breakdown voltage of the separation switch has been proposed (see, for example, patent document 2).

With the scan electrode drive circuit described in patent document 2, the breakdown voltage of the separation switch can be reduced, however, the breakdown voltage of switching elements constituting the scan electrode drive circuit other than the separation switching elements is increased, which increases the impedance of such switching elements.

[Patent document 1] Japanese Patent Unexamined Publication No. 2005-266460

[Patent document 2] Japanese Patent Unexamined Publication No. 2006-201735

SUMMARY OF THE INVENTION

A plasma display device in accordance with the present invention includes a plasma display panel including a scan electrode, a sustain electrode, and a data electrode; and a scan electrode drive circuit for generating a drive waveform to be applied to the scan electrode. The scan electrode drive circuit includes a sustain pulse generating circuit for generating a sustain pulse to be applied to the scan electrode; a first waveform generating circuit for reducing a voltage to be applied to the scan electrode in an initializing period; and a second waveform generating circuit for increasing a voltage to be applied to the scan electrode in the initializing period. The sustain pulse generating circuit includes a first clamping switch for clamping an output to a voltage at a high voltage side of a sustain power supply for generating the sustain pulse; a first separation switch connected in series to the first clamping switch; a second clamping switch for clamping an output to a voltage at a low voltage side of the sustain power supply; and a second separation switch connected in series to the second clamping switch. The output of the first waveform generating circuit is connected to a node to which the sustain pulse is output from the sustain pulse generating circuit, and an output of the second waveform generating circuit is connected to a node between the second clamping switch and the second separation switch.

Such a configuration can provide a plasma display device including a scan electrode drive circuit in which an output impedance is reduced without increasing the breakdown voltage of switching elements constituting a scan electrode drive circuit.

Furthermore, a plasma display device in accordance with the present invention includes a plasma display panel including a scan electrode, a sustain electrode, and a data electrode; and a scan electrode drive circuit for generating a drive waveform to be applied to the scan electrode. The scan electrode drive circuit includes a sustain pulse generating circuit for generating a sustain pulse to be applied to the scan electrode; a first waveform generating circuit for reducing a voltage to be applied to the scan electrode in an initializing period; and a second waveform generating circuit for increasing a voltage to be applied to the scan electrode in the initializing period. The sustain pulse generating circuit includes a first clamping switch for clamping an output to a voltage at a high voltage side of a sustain power supply for generating the sustain pulse; a first separation switch connected in series to the first clamping switch; a second clamping switch for clamping an output to a voltage at a low voltage side of the sustain power supply; and a second separation switch connected in series to the second clamping switch. The output of the first waveform generating circuit may be connected to a node between the first clamping switch and the first separation switch; and the output of the second waveform generating circuit may be connected to a node between the second clamping switch and the second separation switch.

REFERENCE MARKS IN THE DRAWINGS

Figure 1:
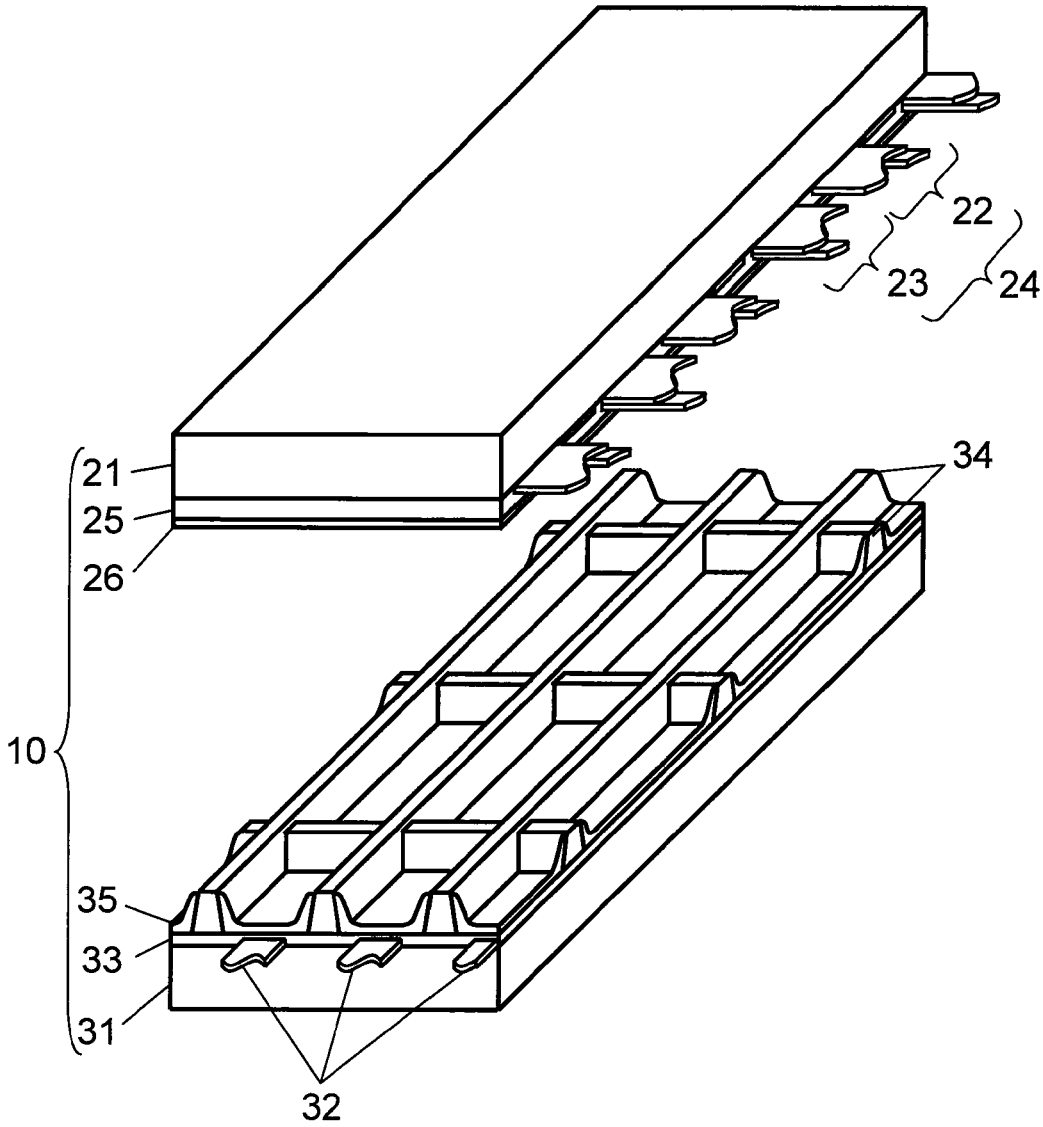
FIG. 1 is an exploded perspective view showing a structure of a panel used in a plasma display device in accordance with a first exemplary embodiment of the present invention.

10 panel
22 scan electrode
23 sustain electrode
24 display electrode pair
32 data electrode
41 image signal processing circuit
42 data electrode drive circuit
43, 143, 243 scan electrode drive circuit
44 sustain electrode drive circuit
45 timing generating circuit
60 scan pulse generating circuit
62 sustain pulse generating circuit
64 second waveform generating circuit
66 first waveform generating circuit
70 clamping part
75 power recovery part
Cp interelectrode capacitance
C71 protective capacitor
C76 electric power recovery capacitor
C77 first damper capacitor
C78 second damper capacitor
D77 back-flow preventing diode
D78 back-flow preventing diode
L77 first recovery inductor
L78 second recovery inductor
N0, N1, N3, N7, N8 node
Q71 transistor (first clamping switch)
Q72 transistor (first separation switch)
Q73 transistor (second separation switch)
Q74 transistor (second clamping switch)
Q77 transistor (first recovery switch)
Q78 transistor (second recovery switch)

DETAILED DESCRIPTION OF THE PREFERRED EMBODIMENTS

Hereinafter, a plasma display device in accordance with exemplary embodiments of the present invention is described with reference to drawings.

First Exemplary Embodiment

FIG. 1 is an exploded perspective view showing a structure of panel 10 used in a plasma display device in accordance with the first exemplary embodiment of the present invention. A plurality of display electrode pairs 24 each composed of scan electrode 22 and sustain electrode 23 are formed on glass front substrate 21. Dielectric layer 25 is formed so as to cover display electrode pairs 24. Protective layer 26 is formed on dielectric layer 25. A plurality of data electrodes 32 are formed on rear substrate 31, dielectric layer 33 is formed so as to cover data electrodes 32, and further double-cross-shaped barrier ribs 34 are formed on dielectric layer 33. Phosphor layer 35 emitting red, green and blue light is provided on the side surface of barrier ribs 34 and on the top surface of dielectric layer 33.

Front substrate 21 and rear substrate 31 are disposed facing each other so that display electrode pairs 24 and data electrodes 32 intersect with each other with minute discharge space interposed therebetween. Front panel 21 and rear panel 31 are sealed to each other on the peripheral portions thereof with a sealing agent such as glass frit. A discharge gas including, for example, xenon is filled in the discharge space. The discharge space is partitioned into a plurality of sections by barrier ribs 34. A discharge cell is formed in a portion where display electrode pair 24 and data electrode 32 intersect with each other. These discharge cells are discharged to emit light, and thereby an image is displayed.

Note here that the structure of panel 10 is not necessarily limited to the above-mentioned structure and, for example, a structure having stripe-shaped barrier ribs may be employed.

Figure 2:
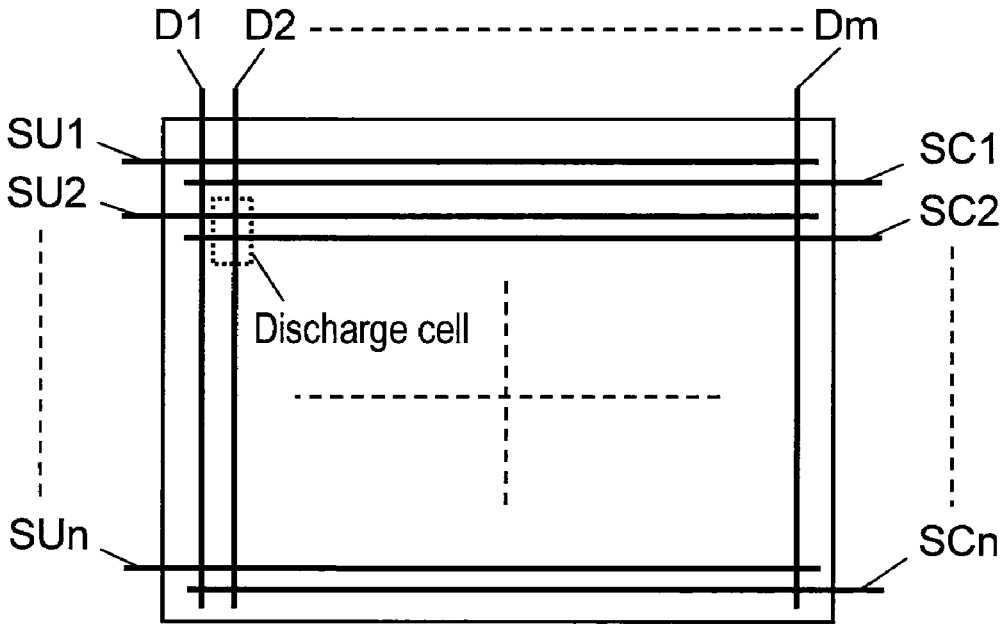
FIG. 2 shows an arrangement of electrodes of the panel used in the plasma display device.

FIG. 2 shows an arrangement of electrodes of panel 10 used in the plasma display device in accordance with the first exemplary embodiment of the present invention. On panel 10, n lines of scan electrodes SC1-SCn (scan electrodes 22 in FIG. 1) and n lines of sustain electrodes SU1-SUn (sustain electrodes 23 in FIG. 1), which are long in the row direction, are arranged, as well as m lines of data electrodes D1-Dm (data electrodes 32 in FIG. 1) which are long in the column direction are arranged. A discharge cell is formed in a portion where a pair of scan electrode SCi (i=1 to n) and sustain electrode SUi intersect with one data electrode Dj (j=1 to m).

The discharge cells of m×n pieces are formed in discharge space. As shown in FIGS. 1 and 2, since scan electrode SCi and sustain electrode SUi are arranged in parallel to each other to form a pair, large interelectrode capacitance Cp exists between scan electrodes SC1-SCn and sustain electrodes SU1-SUn.

Next, the configuration of the plasma display device in accordance with this exemplary embodiment and the operation thereof are described.

Figure 3:
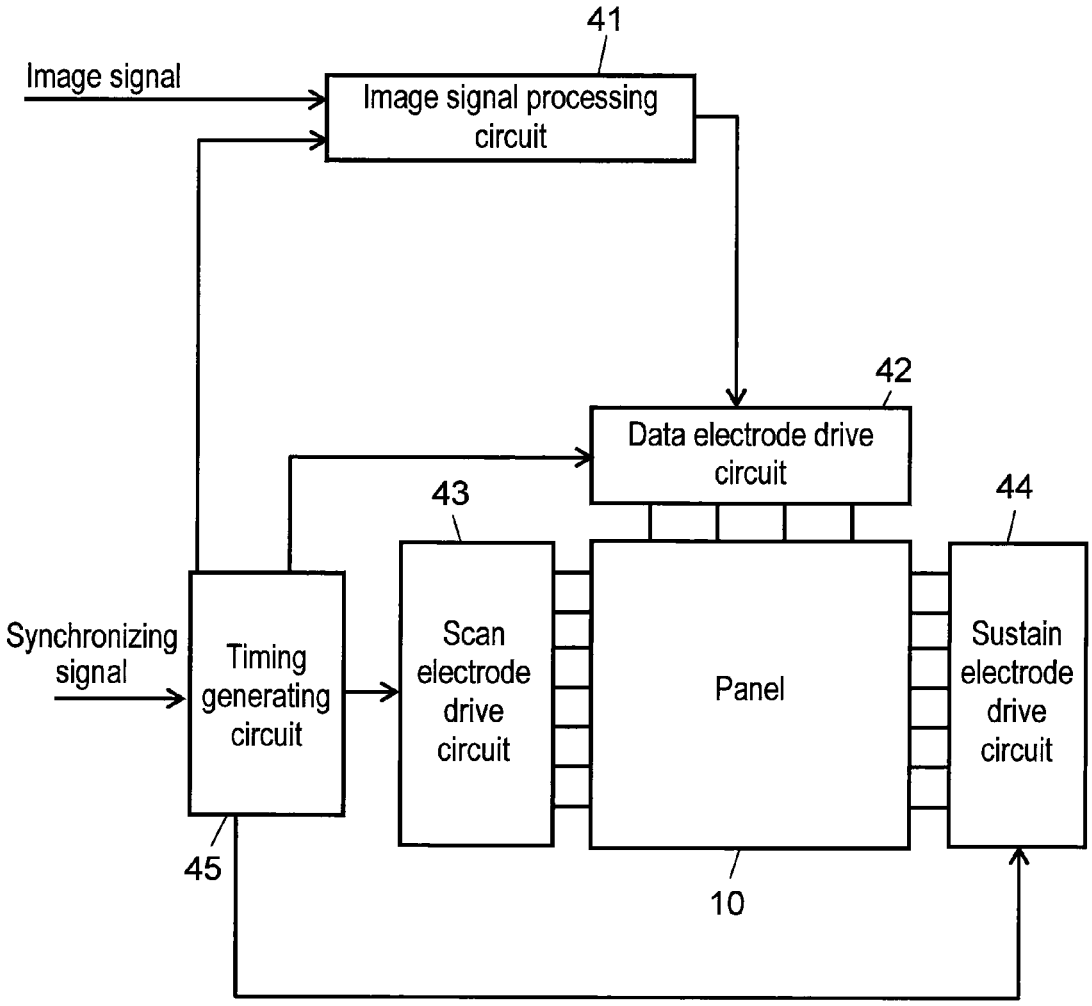
FIG. 3 is a circuit block diagram showing the plasma display device.

FIG. 3 is a circuit block diagram showing the plasma display device in accordance with the first exemplary embodiment of the present invention. The plasma display device includes panel 10, image signal processing circuit 41, data electrode drive circuit 42, scan electrode drive circuit 43, sustain electrode drive circuit 44, timing generating circuit 45, and power circuit (not shown) for supplying power necessary for each circuit block.

Image signal processing circuit 41 converts an image signal into an image signal having a number of pixels and gradation, which can be displayed on panel 10, and further converts light emission/non-light emission for every subfield into image data corresponding to bits "1" and "0" of digital signals. Data electrode drive circuit 42 converts image data into an address pulse corresponding to each of data electrodes D1-Dm and applies it to each of data electrodes D1-Dm.

Timing generating circuit 45 generates various types of timing signals for controlling the operation of each circuit block on the basis of a horizontal synchronizing signal and a vertical synchronizing signal and supplies them to each circuit block. Scan electrode drive circuit 43 and sustain electrode drive circuit 44 generate drive voltage waveforms based on the respective timing signals, and apply them to scan electrodes SC1-SCn and sustain electrodes SU1-SUn, respectively.

Figure 4:
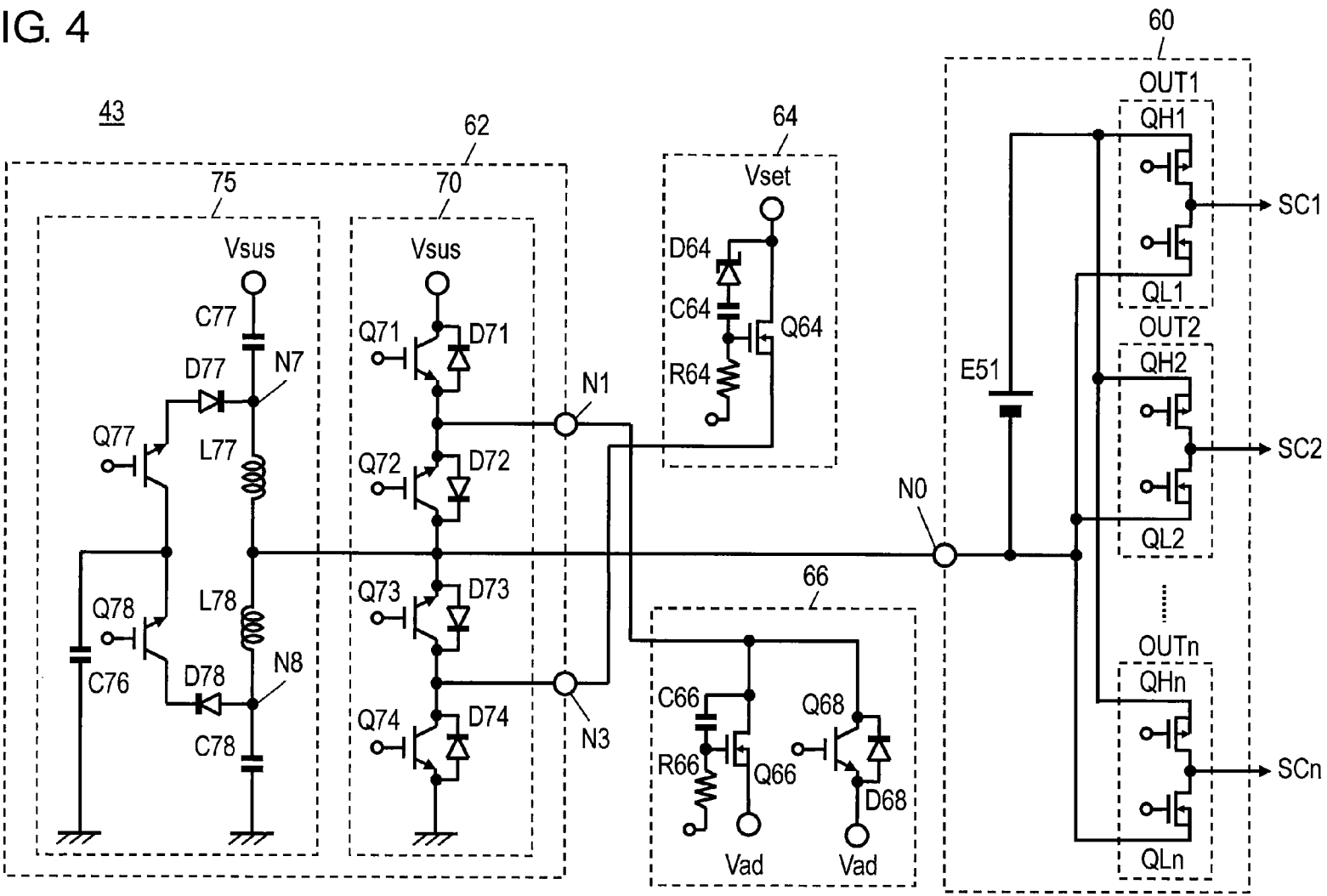
FIG. 4 is a circuit diagram showing a detail of a scan electrode drive circuit of the plasma display device.

FIG. 4 is a circuit diagram showing a detail of scan electrode drive circuit 43 of the plasma display device. Scan electrode drive circuit 43 includes scan pulse generating circuit 60 for generating a scanning pulse, sustain pulse generating circuit 62 for generating a sustain pulse to be applied to scan electrodes SC1-SCn and superimposing the sustain pulse to a voltage at node N0 of scan pulse generating circuit 60, second waveform generating circuit 64 for increasing a voltage to be applied to scan electrodes SC1-SCn in an initializing period, and first waveform generating circuit 66 for reducing a voltage to be applied to scan electrodes SC1-SCn in the initializing period. In this exemplary embodiment, a voltage at a high voltage side of the sustain power supply is sustain pulse voltage Vsus, and a voltage at a low voltage side of the sustain power supply is a ground voltage (hereinafter, referred to as GND), that is, 0 (V).

Scan pulse generating circuit 60 includes power supply E51 of voltage Vsc superimposed to the voltage at node N0, and switch parts OUT1-OUTn for outputting a scan pulse voltage to each of scan electrodes SC1-SCn. Power supply E51 may be configured by using a DC-DC converter, or by using a bootstrap driver circuit. Each of switch parts OUT1-OUTn includes transistors QL1-QLn for outputting a voltage at node N0, and transistors QH1-QHn for outputting voltage Vsc superimposed to the voltage at node N0.

Sustain pulse generating circuit 62 includes clamping part 70 and power recovery part 75. Clamping part 70 includes transistor Q71 as a first clamping switch for clamping an output to a voltage at the high voltage side of the sustain power supply for generating a sustain pulse, transistor Q72 as a first separation switch connected back-to-back in series to the first clamping switch, transistor Q74 as a second clamping switch for clamping an output to a voltage at the low voltage side of the sustain power supply, and transistor Q73 as a second separation switch connected back-to-back in series to the second clamping switch. That is to say, transistor Q71 as the first clamping switch and transistor Q72 as the first separation switch are connected in series between voltage Vsus of the sustain power supply and node N0 in a way in which an electric current to be controlled become opposite to each other. Furthermore, transistor Q74 as the second clamping switch and transistor Q73 as the second separation switch are connected in series between GND and node N0 in a way in which an electric current to be controlled become opposite to each other.

For the first clamping switch, the first separation switch, the second clamping switch and the second separation switch, an insulated gate bipolar transistor or a field-effect transistor can be used, respectively. That is to say, an emitter or a source of the first clamping switch and an emitter or a source of the first separation switch may be connected to each other, and a collector or a drain of the second clamping switch and a collector or a drain of the second separation switch may be connected to each other.

In this exemplary embodiment, IGBT is used for transistors Q71-Q74 in which an emitter of transistor Q71 and an emitter of transistor Q72 are connected to each other, and a collector of transistor Q73 and a collector of transistor Q74 are connected to each other. Hereinafter, a node at which the emitter of transistor Q71 and the emitter of transistor Q72 are connected to each other is referred to as "node N1," and a node at which the collector of transistor Q73 and the collector of transistor Q74 are connected to each other is referred to as "node N3."

Furthermore, diode D71, diode D72, diode D73 and diode D74 for allowing an electric current flowing from the emitter to the collector to bypass are connected in parallel to transistor Q71, transistor Q72, transistor Q73 and transistor Q74, respectively. Therefore, when transistor Q71 is turned on, an electric current can be allowed to flow from the sustain power supply of voltage Vsus to node N0 via transistor Q71 and diode D72. Furthermore, when transistor Q72 is turned on, an electric current can be allowed to flow from node N0 to the sustain power supply via transistor Q72 and diode D71. Furthermore, when transistor Q74 is turned on, an electric current can be allowed to flow from node N0 to GND via diode D73 and transistor Q74. Furthermore, when transistor Q73 is turned on, an electric current can be allowed to flow from GND to node N0 to via diode D74 and transistor Q73.

Note here that when a field-effect transistor is used for the switching element, since a body diode of the field-effect transistor allows an electric current in the opposite direction to bypass, a corresponding diode may be omitted.

As mentioned above, sustain pulse generating circuit 62 includes clamping part 70 and power recovery part 75. Power recovery part 75 includes electric power recovery capacitor C76; transistor Q77 as a first recovery switch, back-flow preventing diode D77 and first recovery inductor L77, which are connected in series so as to form an electric current passage in which an electric current is allowed to flow from electric power recovery capacitor C76 to scan electrodes SC1-SCn; and transistor Q78 as a second recovery switch, back-flow preventing diode D78 and second recovery inductor L78, which are connected in series so as to form an electric current passage in which an electric current is allowed to flow from scan electrodes SC1-SCn to electric power recovery capacitor C76. Interelectrode capacitance Cp of panel 10 and first recovery inductor L77 or second recovery inductor L78 are allowed to LC resonance to each other, thus rising and falling the sustain pulse. A node at which back-flow preventing diode D77 and first recovery inductor L77 are connected to each other is referred to as "node N7," and a node at which back-flow preventing diode D78 and second recovery inductor L78 are connected to each other is referred to as "node N8." Furthermore, in order to suppress ringing, power recovery part 75 includes first damper capacitor C77 connected to node N7 between the first recovery switch and first recovery inductor L77, and second damper capacitor C78 connected to node N8 between the second recovery switch and second recovery inductor L78. Power recovery part 75 suppresses ringing so that an excess voltage is not applied to back-flow preventing diodes D77 and D78. Electric power recovery capacitor C76 has sufficiently larger capacitance as compared with interelectrode capacitance Cp, and is charged to about Vsus/2 that is half of voltage Vsus so that it works as a power supply of power recovery part 75.

Second waveform generating circuit 64 in this exemplary embodiment is configured by a Miller integrating circuit including field-effect transistor Q64, capacitor C64, resistor R64, and Zener diode D64 which are connected to a power supply of voltage Vset, and generates an upward inclined waveform voltage for gently increasing a voltage at node N0. A drain of transistor Q64 is connected to the power supply of voltage Vset; and a source of transistor Q64 is connected to a connection point, that is, node N3, between transistor Q73 and transistor Q74. Thus, second waveform generating circuit 64 increases a voltage applied to scan electrodes SC1-SCn in the initializing period.

First waveform generating circuit 66 includes a Miller integrating circuit including field-effect transistor Q66, capacitor C66 and resistor R66 which are connected to voltage Vad and generates a downward inclined waveform voltage that gently reduce the voltage at node N0. A source of transistor Q66 is connected to the power supply of voltage Vad, and a drain of transistor Q66 is connected to a connection point, that is, node N1 between transistor Q71 and transistor Q72. Furthermore, first waveform generating circuit 66 includes transistor Q68 and diode D68, which are connected to voltage Vad, and clamps the voltage at node N0 to voltage Vad. Then, an emitter of transistor Q68 is connected to a power supply of voltage Vad, and a collector of transistor Q68 is connected to node N1 between transistor Q71 and transistor Q72. Thus, first waveform generating circuit 66 reduces a voltage to be applied to scan electrodes SC1-SCn in the initializing period.

Thus, scan electrode drive circuit 43 has a configuration in which an output of first waveform generating circuit 66 is connected to node N1 between the first clamping switch and the first separation switch, and the output of second waveform generating circuit 64 is connected to node N3 between the second clamping switch and the second separation switch. Therefore, when scan electrode drive circuit 43 is configured in this way, a voltage at node N0 can be set to voltages such as a rising inclined waveform voltage, a downward inclined waveform voltage, voltage Vsus, and negative voltage Vad, and 0 (V).

Next, an operation of scan electrode drive circuit 43 and a method for driving panel 10 are described. Panel 10 employs a subfield method, in which one field period is divided into a plurality of subfields, and light emission/non-emission of each discharge cell is controlled for every subfield. Each subfield includes an initializing period, an address period, and a sustain period.

In the initializing period, initializing discharge is generated so as to form wall charge necessary for the subsequent address discharge on each electrode. In the address period, a scanning pulse as an address voltage is applied to scan electrodes SC1-SCn, and an address pulse is selectively applied to data electrodes D1-Dm so as to generate address discharge selectively in a discharge cell to emit light, thus forming wall charge. Then, in the sustain period, sustain pulses of the number corresponding to a brightness weight are alternately applied to the display electrode pair so as to cause sustain discharge to emit light in a discharge cell in which address discharge has been generated.

Figure 5:
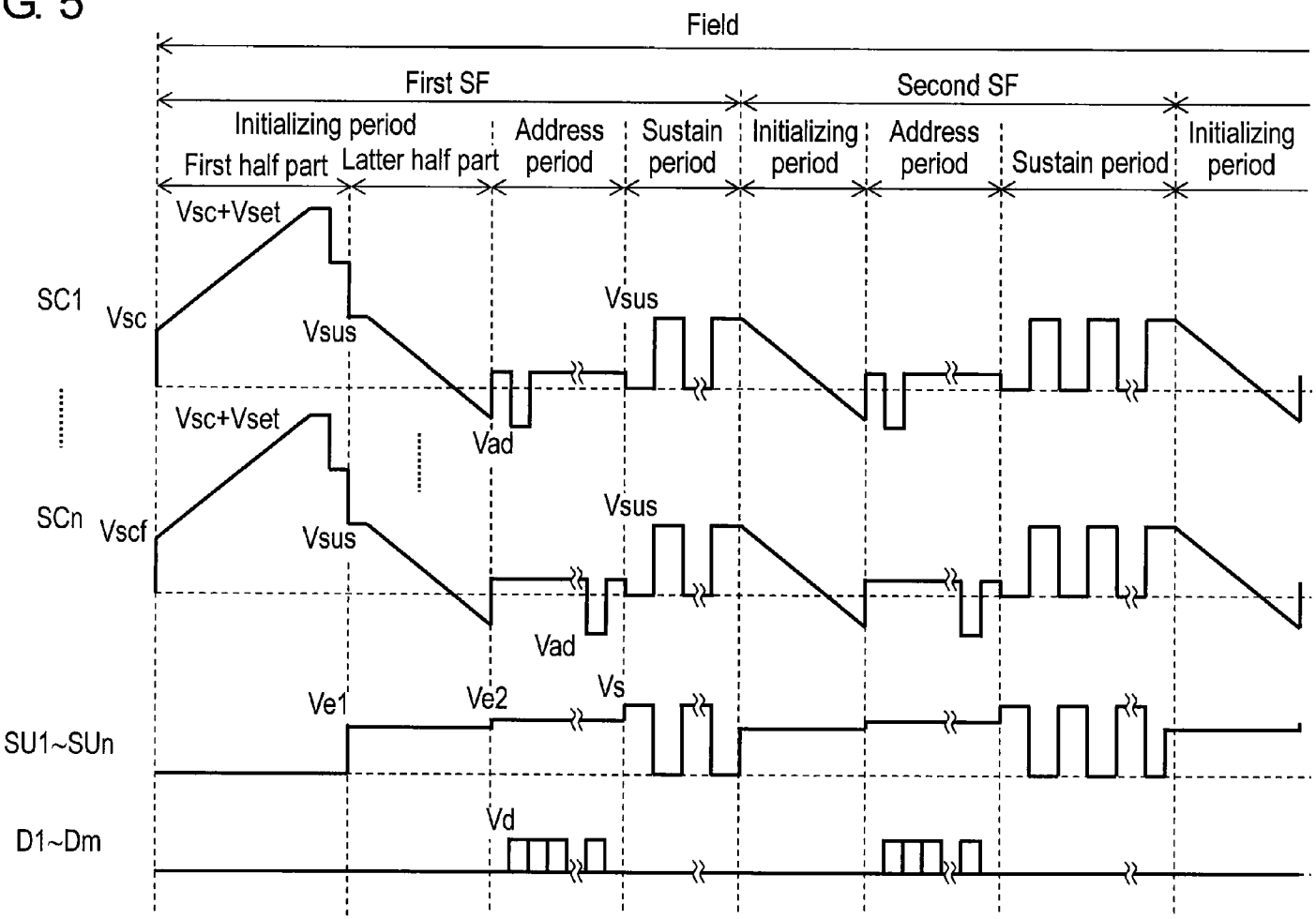
FIG. 5 shows a drive voltage waveform applied to each electrode of a panel of the plasma display device.
Figure 6:
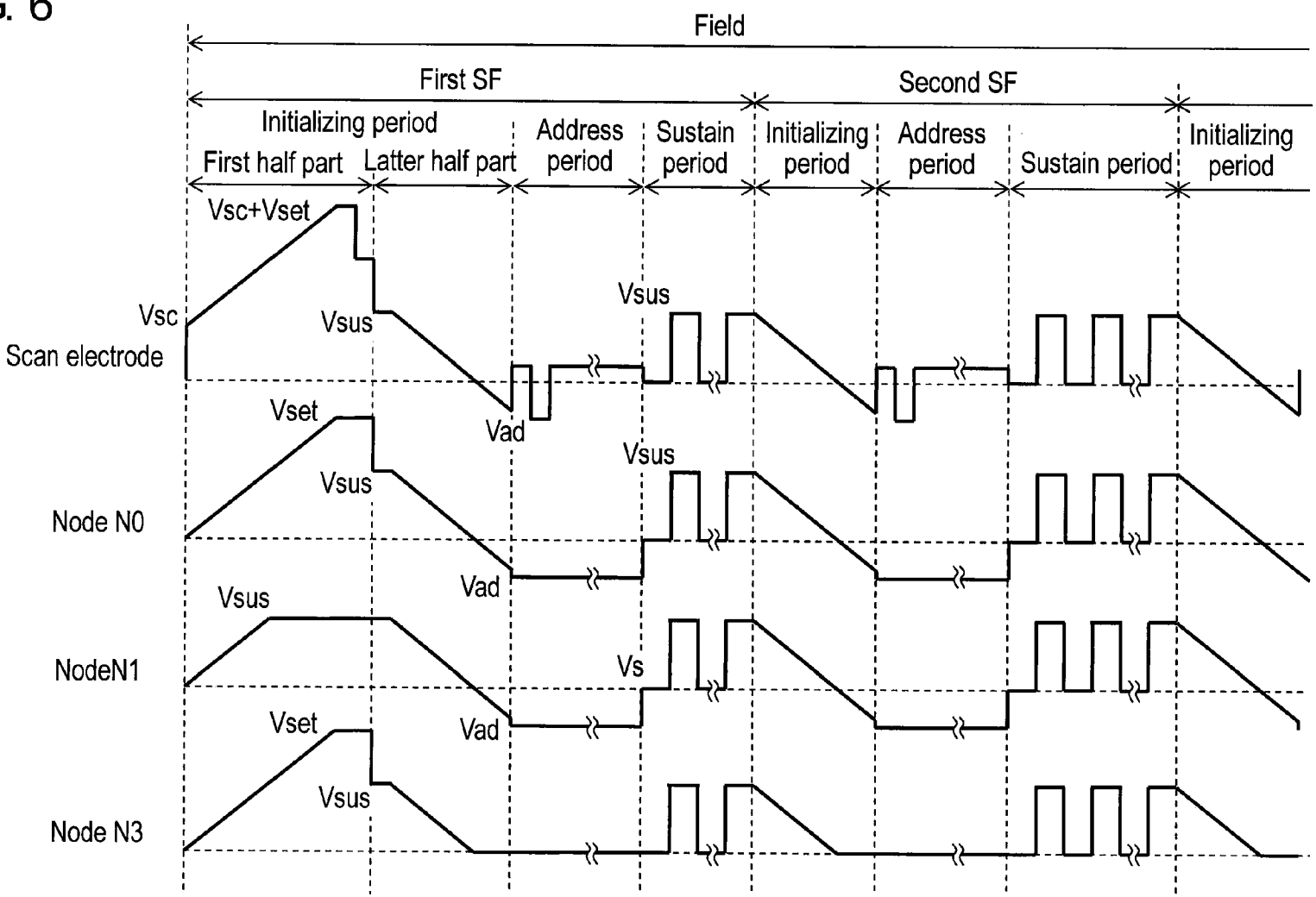
FIG. 6 shows a waveform at each node in the scan electrode drive circuit of the plasma display device.

FIG. 5 shows a drive voltage waveform applied to each electrode of panel 10 of the plasma display device in accordance with the first exemplary embodiment of the present invention, which shows drive voltage waveforms of two subfields. Furthermore, FIG. 6 shows voltage waveforms at nodes N0, N1, and N3 of scan electrode drive circuit 43 of the plasma display device in accordance with the first exemplary embodiment of the present invention.

In the first half part of the initializing period, a voltage of 0 (V) is applied to data electrodes D1-Dm and sustain electrodes SU1-SUn, respectively, and a gently increasing upward inclined waveform voltage is applied to scan electrodes SC1-SCn.

In order to apply an upward inclined waveform voltage to scan electrodes SC1-SCn, transistors Q73 and Q74 are turned on and voltage VN0 at node N0 is set to 0 (V); and transistors QH1-QHn of switch parts OUT1-OUTn are turned on so as to apply voltage Vsc to scan electrodes SC1-SCn. Next, transistor Q74 is turned off and transistor Q64 is turned on so as to operate a Miller integrating circuit. Then, voltage VN3 at node N3 is gently increased toward voltage Vset after the voltage is increased by Zener voltage Vz of Zener diode D64. Since transistor Q73 as a separation switch is turned on, similar to voltage VN3 at node N3, voltage VN0 at node N0 is gently increased toward voltage Vset. Thus, each of switch parts OUT1-OUTn outputs a voltage obtained by superimposing voltage Vsc to voltage VN0 at node N0, an inclined waveform voltage gently increasing toward voltage (Vsc+Vset) is applied to scan electrodes SC1-SCn.

Herein, voltage VN7 and voltage VN8 at node N7 and node N8 of power recovery part 75 are also gently increased toward voltage Vset similar to node N0. Supposing that node N7 and node N8 are clamped to voltage Vsus by the diode, voltage VN0 at node N0 cannot be increased to voltage Vsus or higher. In this exemplary embodiment, however, since only first damper capacitor C77 and second damper capacitor C78 are connected to node N7 and node N8, respectively, voltages VN7 and VN8 at nodes N7 and N8 can be increased to voltage Vsus or higher, and voltage VN0 at node N0 can be generally increased toward voltage Vset.

While this inclined waveform voltage is increased, feeble initializing discharge occurs between scan electrodes SC1-SCn and sustain electrodes SU1-SUn and between scan electrodes SC1-SCn and data electrodes D1-Dm, respectively. Wall voltage is accumulated on the respective electrodes. Herein, the wall voltage on the electrode denotes a voltage generated by wall charges accumulated on a dielectric layer, a protective layer, and a phosphor layer, and the like, which cover the electrode.

In the latter half part of the initializing period, positive voltage Ve1 is applied to sustain electrodes SU1-SUn and a gently reducing downward inclined waveform voltage is applied to scan electrodes SC1-SCn.

Before the downward inclined waveform voltage is applied to scan electrodes SC1-SCn, firstly, transistor Q64 is turned off. Then, transistor Q71 and transistor Q72 are turned on so as to change voltage VN0 at node N0 to voltage Vsus. Thereafter, transistors QH1-QHn of switch parts OUT1-OUTn is turned off and transistors QL1-QLn are turned on so as to apply a voltage at node N0, that is, voltage Vsus to scan electrodes SC1-SCn. Then, transistor Q71 and transistor Q73 are turned off and transistor Q66 is turned on so as to operate a Miller integrating circuit. Then, voltage VN1 at node N1 generally decreases toward voltage Vad. Since transistor Q72 as a separation switch is turned on, similar to voltage VN1 at node N1, voltage VN0 at node N0 is gently reduced toward voltage Vad. Thus, an inclined waveform voltage that is gently reduced toward voltage Vad is applied to scan electrodes SC1-SCn.

Herein, voltage VN7 and voltage VN8 at node N7 and node N8 of power recovery part 75 are gently reduced toward voltage Vad similar to node N0. Supposing that node N7 and node N8 are clamped to GND by the diode, voltage VN0 at node N0 cannot be reduced to 0 (V) or lower. In this exemplary embodiment, however, since only first damper capacitor C77 and second damper capacitor C78 are connected to node N7 and node N8, respectively, voltages VN7 and VN8 at nodes N7 and N8 can be increased to 0 (V) or lower, and voltage VN0 at node N0 can be generally reduced toward voltage Vad.

Then, while this inclined waveform voltage is reduced, feeble initializing discharge occurs again between scan electrodes SC1-SCn and sustain electrodes SU1-SUn and between scan electrodes SC1-SCn and data electrodes D1-Dm, respectively. Wall voltage on each electrode is adjusted to a value suitable for the address operation. In this exemplary embodiment, in order to make a fine adjustment of the wall voltage, immediately before the voltage applied to scan electrodes SC1-SCn reaches voltage Vad, the voltage drop is stopped.

Thus, during the initializing period, initializing discharge is generated, and wall charge necessary for subsequent address discharge is formed on each electrode. Note here that the first half part of the initializing period may be omitted as shown in the initializing period of a second subfield in FIG. 5. In this case, initializing discharge selectively occurs in a discharge cell in which sustain discharge has been carried out in the sustain period of the immediately preceding subfield.

In the subsequent address period, firstly, voltage Ve2 is applied to sustain electrodes SU1-SUn and voltage (Vad+Vsc) is applied to scan electrodes SC1-SCn. Thereafter, negative scan pulse voltage Vad is applied to scan electrode SC1 and positive address pulse voltage Vd is applied to data electrode Dk (k=1 m) of the discharge cell in which light is to be emitted in a first row of data electrodes D1-Dm.

In order to apply scan pulse voltage Vad to scan electrode SC1, firstly, transistor Q68 is turned on so as to set voltage VN1 at node N1 to negative voltage Vad. Since transistor Q72 as a separation switch is turned on, voltage VN0 at node N0 is also negative voltage Vad similar to voltage VN1 at node N1. Then, transistors QH1-QHn of switch parts OUT1-OUTn are turned on and transistors QL1-QLn are turned off so as to apply voltage (Vad+Vsc) to scan electrodes SC1-SCn. Next, transistor QH1 is turned off and transistor QL1 is turned on, thereby applying negative scan pulse voltage Vad to the first row of scan electrode SC1.

Then, address discharge occurs in a discharge cell in which an address pulse has been applied among the first row of discharge cells, and an address operation, in which wall voltage is accumulated on each electrode, is carried out. On the other hand, in a discharge cell in which address pulse voltage Vd has not been applied, address discharge does not occur. In this way, an address operation is selectively carried out.

Next, transistor QH1 is turned on again, transistor QL1 is turned off again, transistor QH2 is turned off, and transistor QL2 is turned on, so that scan pulse voltage Vad is applied to the second row of scan electrode SC2, while address pulse voltage Vd is applied data electrode Dk of a discharge cell in which light is to be emitted in the second row among data electrodes D1-Dm. Then, address discharge selectively occurs in the second row of the discharge cell. The above-mentioned address operation is carried out until a discharge cell in the n-th row.

Thereafter, transistor Q68 is turned off. Then, transistors Q73 and Q74 are turned on so as to set voltage VN3 at node N3 and voltage VN0 at node N0 to 0 (V). Furthermore, transistors QH1-QHn of switch parts OUT1-OUTn are turned off and transistors QL1-QLn are turned on so as to apply 0 (V) to scan electrodes SC1-SCn.

Figure 7:
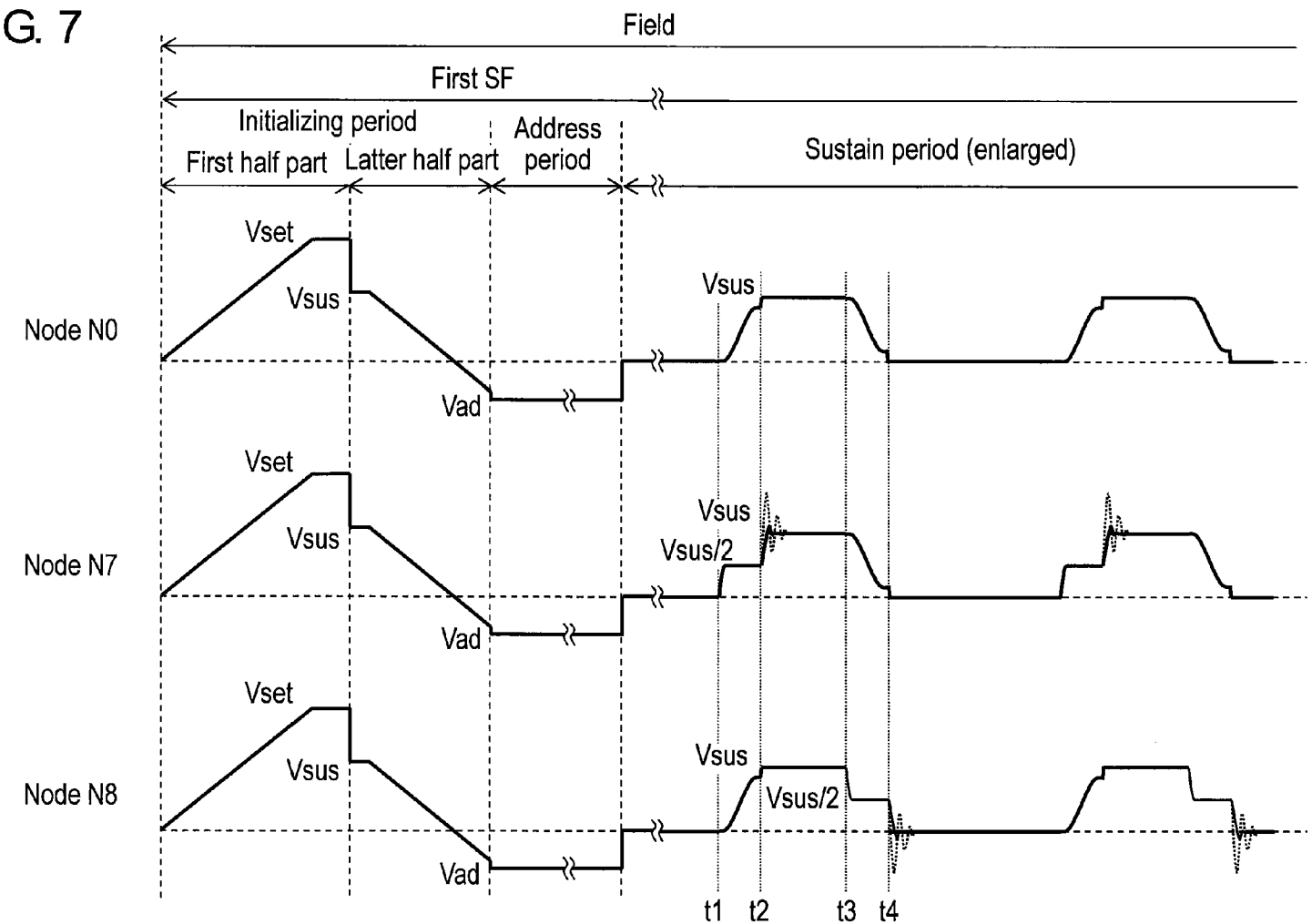
FIG. 7 shows a waveform at each node in the scan electrode drive circuit of the plasma display device.

In the subsequent sustain period, 0 (V) is applied to sustain electrodes SU1-SUn, and sustain pulse voltage Vsus is applied to scan electrodes SC1-SCn. FIG. 7 shows voltage waveforms at nodes N0, N7 and N8 of scan electrode drive circuit 43 of the plasma display device in accordance with the first exemplary embodiment of the present invention. In particular, FIG. 7 shows the detail of the voltage waveforms in the sustain period.

In order to apply sustain pulse voltage Vsus to scan electrodes SC1-SCn, firstly, transistor Q77 is turned on at time t1 shown in FIG. 7. Then, voltage VN7 at node N7 becomes equal to voltage Vsus/2 of electric power recovery capacitor C76. As a result, an electric current starts to flow from electric power recovery capacitor C76 via transistor Q77, back-flow preventing diode D77, first recovery inductor L77 and transistors QL1-QLn. Then, the voltages of scan electrodes SC1-SCn start to be increased. Since first recovery inductor L77 and interelectrode capacitance Cp form a resonance circuit, after the time of ½ of resonance period has passed, the voltages of scan electrodes SC1-SCn are increased to the voltage around voltage Vsus.

It is noted that switching elements included between electric power recovery capacitor C76 and scan electrode SCi are only transistor Q77, transistor QLi, and back-flow preventing diode D77 and that a separation switch is not included. By minimizing the number of switching elements to be included in the electric current passage, an output impedance of scan electrode drive circuit 43 is suppressed so as to suppress the electric loss.

Then, at time t2, transistor Q71 is turned on. Then, voltages VN1 and VN0 at node N1 and N0 become voltage Vsus and voltage Vsus is applied to scan electrodes SC1-SCn. Furthermore, voltage VN7 at node N7 is also increased to voltage Vsus.

It is noted that switching elements included between power supply Vsus and scan electrode SCi are only transistor Q71, transistor QLi, and diode D72, or transistor Q71, transistor Q72, and transistor QLi and that further switching elements are not included. By minimizing the number of switching elements to be included in the electric current passage, the output impedance of scan electrode drive circuit 43 is suppressed.

Furthermore, since voltage VN0 at node N0 is rapidly increased to voltage Vsus, back-flow preventing diode D77 is blocked. However, since first recovery inductor L77 is continuously supplied with an electric current via first damper capacitor C77, large ringing does not occur in node N7. Supposing that first damper capacitor C77 is not provided, a large voltage is generated in first recovery inductor L77, so that large ringing occurs as shown by a broken line in FIG. 7. However, in this exemplary embodiment, by providing first damper capacitor C77, ringing is suppressed and an excessive voltage is not applied to back-flow preventing diode D77.

Thus, voltages of scan electrodes SC1-SCn are increased to voltage Vsus forcedly, sustain discharge occurs in a discharge cell in which address discharge has occurred. Thereafter, transistors Q77 and Q71 are turned off.

Subsequently, 0 (V) is applied to scan electrodes SC1-SCn, and sustain pulse voltage Vsus is applied to sustain electrodes SU1-SUn.

In order to apply 0 (V) to scan electrodes SC1-SCn, firstly transistor Q78 is turned on at time t3 shown in FIG. 7. Then, voltage VN8 at node N8 becomes equal to voltage Vsus/2 of electric power recovery capacitor C76. As a result, an electric current starts to flow from scan electrodes SC1-SCn to electric power recovery capacitor C76 via transistors QL1-QLn, second recovery inductor L78, back-flow preventing diode D78, and transistor Q78. Then, voltages of scan electrodes SC1-SCn start to be reduced. Since second recovery inductor L78 and interelectrode capacitance Cp form a resonance circuit, after the time of ½ of resonance period has passed, the voltages of scan electrodes SC1-SCn are reduced to a voltage around 0(V).

Also herein, switching elements included between scan electrode SCi and electric power recovery capacitor C76 are only transistor Q78, transistor QLi and back-flow preventing diode D78 and that a separation switch is include. By minimizing the number of switching elements to be included in the electric current passage, the output impedance of scan electrode drive circuit 43 is suppressed.

Next, at time t4, transistor Q74 is turned on. Then, voltages VN3 and VN0 at node N3 and N0 become voltage 0 (V), and 0 (V) is applied to scan electrodes SC1-SCn. Furthermore, voltage VN8 at node N8 is also reduced to voltage 0 (V).

Also herein, switching elements included between GND and scan electrode SCi are only transistor Q74, transistor QLi, and diode D73, or transistor Q74, transistor Q73 and transistor QLi, and that further switching elements are not included. By minimizing the number of switching elements to be included in the electric current passage, the output impedance of scan electrode drive circuit 43 is suppressed.

Furthermore, since voltage VN0 at node N0 is rapidly reduced to voltage 0 (V), back-flow preventing diode D78 is blocked. However, since second recovery inductor L78 is continuously supplied with an electric current via second damper capacitor C78, a large ringing as shown by a broken line in FIG. 7 does not occur in node N8. By providing second damper capacitor C78 in this way, ringing is suppressed and an excessive voltage is not applied to back-flow preventing diode D78, thus avoiding the breakdown voltage deterioration.

By increasing the capacitance values of first damper capacitor C77 and second damper capacitor C78, an effect of suppressing the ringing is increased. However, when these capacitance values are increased, an effect of recovering electric power is reduced, and the reactive power is increased. Therefore, it is desirable that the capacitance of first damper capacitor C77 and second damper capacitor C78 is appropriately set on the basis of the inductance of first recovery inductor L77 and second recovery inductor L78, parasitic capacitance of back-flow preventing diode D77 and back-flow preventing diode D78, and recovery property, and the like. In this exemplary embodiment, the capacitance of first damper capacitor C77 and second damper capacitor C78 is set to 200 pF to 3000 pF, for example, 1000 pF.

In this way, 0 (V) is applied to scan electrodes SC1-SCn. When sustain pulse voltage Vsus is applied to sustain electrodes SU1-SUn, sustain discharge occurs in a discharge cell in which address discharge has occurred. Thereafter, transistors Q78 and Q74 are turned off.

Hereinafter, in the same way, sustain pulses of the number corresponding to a brightness weight are alternately applied scan electrodes SC1-SCn and sustain electrodes SU1-SUn so as to give the potential difference between electrodes of the display electrode pair. Thereby, in the address period, sustain discharge is continuously carried out in a discharge cell in which address discharge has occurred. In this exemplary embodiment, in the sustain period, transistors Q72 and Q73 are turned on. Since operations of the subsequent subfields are substantially the same, the description thereof is omitted.

As described above, in scan electrode drive circuit 43 in this exemplary embodiment, the switching elements included between electric power recovery capacitor C76 and scan electrode SCi are only two transistors and one diode. Furthermore, the switching elements included between the power supply of voltage Vsus and scan electrode SCi and between GND and scan electrode SCi are only two transistors and one diode or three transistors. Furthermore, switching elements included between each power supply of voltage Vset and voltage Vad and scan electrode SCi are also only two transistors and one diode or three transistors. In this way, in this exemplary embodiment, the number of switching elements to be included in each electric current passage is made to be three or less, thereby suppressing the output impedance of scan electrode drive circuit 43.

Next, the breakdown voltage of each switching element is described. As is apparent from FIG. 4, a voltage applied to transistor Q71 and diode D71 is a difference between voltage Vsus and voltage VN1 at node N1. Furthermore, a voltage applied to transistor Q72 and diode D72 is a difference between voltage VN1 at node N1 and voltage VN0 at node N0. A voltage applied to transistor Q73 and diode D73 is a difference between voltage VN0 at node N0 and voltage VN3 at node N3. A voltage applied to transistor Q74 and diode D74 is a difference between voltage VN1 at node N1 and voltage 0 (V).

Each voltage value of power supply used in this exemplary embodiment is assumed to be, for example, voltage Vset=330 (V), voltage Vsus=190 (V), voltage Vsc=140 (V), voltage Vad=−100 (V), voltage Ve1=160 (V) and voltage Ve2=170 (V). FIG. 6 shows that the difference between voltage Vsus and voltage VN1 at node N1 is (Vsus−Vad)=290 (V) at the maximum. Therefore, for transistor Q71 and diode D71, for example, an element having a breakdown voltage of 350 (V) can be used. Furthermore, since the difference between voltage VN1 at node N1 and voltage VN0 at node N0 is (Vset−Vsus)=140 (V) at the maximum, for example, an element having a breakdown voltage of 200 (V) can be used for transistor Q72 and diode D72. Furthermore, since the difference between voltage VN0 at node N0 and voltage VN3 at node N3 is (0−Vad)=100 (V) at the maximum, for example, an element having a breakdown voltage of 150 (V) can be used for transistor Q73 and diode D73. Furthermore, since the difference between voltage VN3 at node N3 and voltage 0 (V) is Vset=330 (V) at the maximum, for example, an element having a breakdown voltage of 400 (V) can be used for transistor Q74 and diode D74.

Similarly, when the breakdown voltage of a transistor to be used for second waveform generating circuit 64 and first waveform generating circuit 66 is estimated, since the difference between voltage Vset and voltage VN1 at node N1 is (Vset−0)=330 (V) at the maximum, for example, an element having a breakdown voltage of 400 (V) can be used for transistor Q64. Furthermore, since the difference between voltage Vad and voltage VN3 at node N3 is (Vad−Vsus)=−290

(V) at the maximum, for example, an element having a breakdown voltage of 350 (V) can be used for transistors Q66 and Q68.

Furthermore, when the breakdown voltage of the switching elements is estimated assuming that the ringing at nodes N7 and N8 are sufficiently suppressed by first damper capacitor C77 and second damper capacitor C78, the difference between a voltage of electric power recovery capacitor C76 and voltage VN0 at node N0 is (Vsus/2−Vad)=195 (V) and (Vsus/2−Vset)=−235 (V). However, a voltage of electric power recovery capacitor C76 may be changed from 0 (V) to Vsus/2. Thus, the difference estimated with this margin included is in the range from 195 (V) to −330 (V). Therefore, for example, an element having a breakdown voltage of 300 (V) can be used for transistor Q77 and back-flow preventing diode D78, and, for example, an element having a breakdown voltage of 400 (V) can be used for transistor Q78 and back-flow preventing diode D77, respectively.

Thus, in this exemplary embodiment, the output impedance of scan electrode drive circuit 43 can be reduced without increasing the breakdown voltages of the switching elements constituting scan electrode drive circuit 43.

Second Exemplary Embodiment

Next, a plasma display device including a scan electrode drive circuit additionally including a protective circuit for every separation switch is described. The protective circuit is provided so that an excessive voltage is not applied to a separation switch at the timing at which a voltage at a node to which a separation switch is connected becomes indeterminate.

Figure 8:
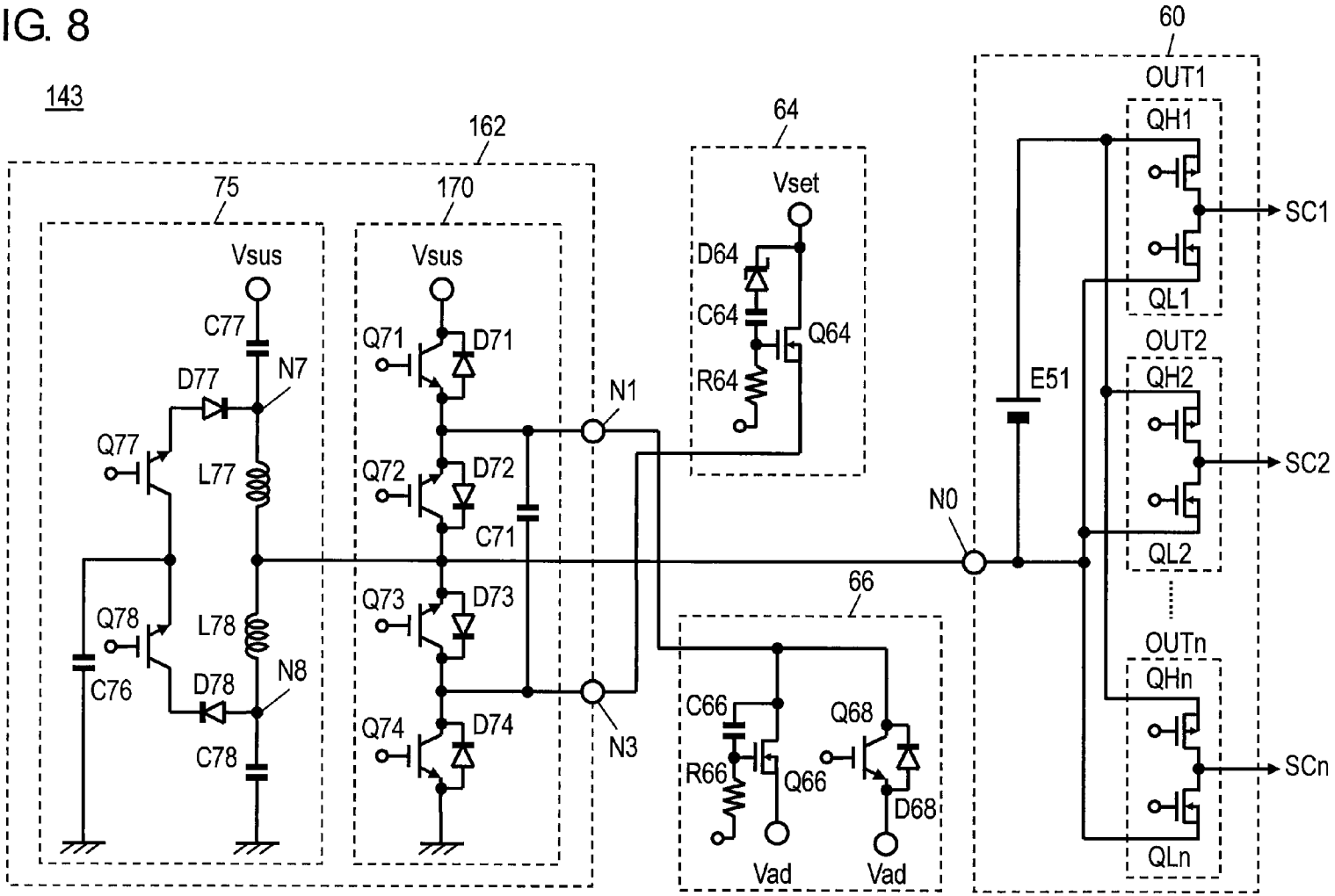
FIG. 8 is a circuit diagram showing a detail of a scan electrode drive circuit of a plasma display device in accordance with a second exemplary embodiment of the present invention.

FIG. 8 is a circuit diagram showing a detail of scan electrode drive circuit 143 of a plasma display device in accordance with a second exemplary embodiment of the present invention. The same reference numerals are given to the same parts as those in the first exemplary embodiment and the detailed description thereof is omitted.

This exemplary embodiment is different from the first exemplary embodiment in that this exemplary embodiment includes protective capacitor C71 connected between node N1 between first clamping switch Q71 and first separation switch Q72 and node N3 between second clamping switch Q74 and second separation switch Q73 in clamping part 170 of sustain pulse generating circuit 162. That is to say, protective capacitor C71 is connected between node N1 and node N3.

Next, an operation of scan electrode drive circuit 143 and a driving method of panel 10 are described.

Figure 9:
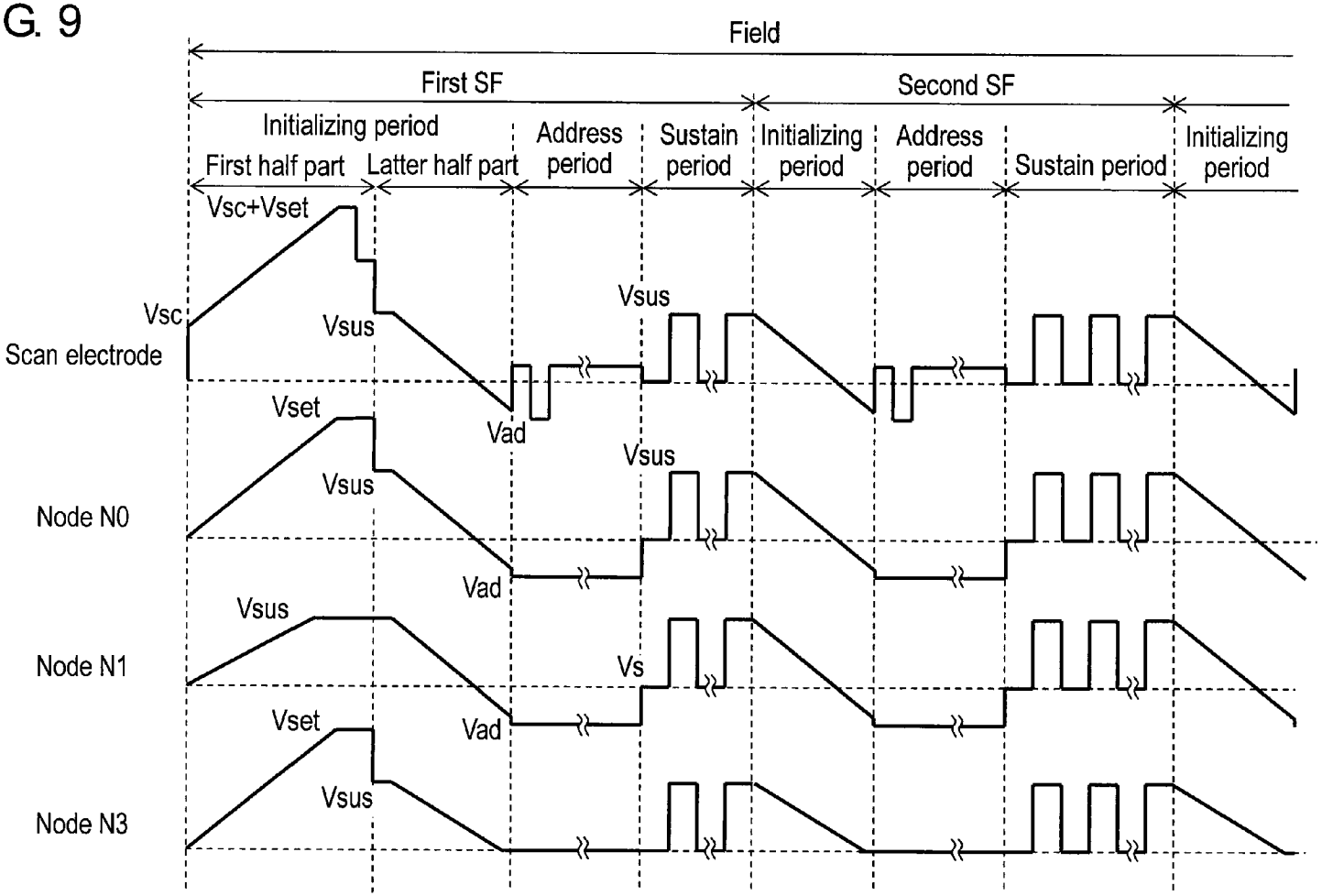
FIG. 9 shows a voltage waveform of a node in the scan electrode drive circuit of the plasma display device in accordance with the second exemplary embodiment of the present invention.

A drive voltage waveform applied to each electrode of panel 10 of the plasma display device in accordance with the second exemplary embodiment is similar to the drive voltage waveform in the first exemplary embodiment shown in FIG. 5. Furthermore, FIG. 9 shows voltage waveforms of node N0, node N1 and node N3 of scan electrode drive circuit 143 of the plasma display device in accordance with the second exemplary embodiment of the present invention.

In the first half part of the initializing period, a voltage of 0 (V) is applied to data electrodes D1-Dm and sustain electrodes SU1-SUn, respectively, and a gently increasing upward inclined waveform voltage is applied to scan electrodes SC1-SCn.

In order to apply an upward inclined waveform voltage to scan electrodes SC1-SCn, transistors Q73, Q74 and Q72 are turned on and voltage VN0 at node N0, VN1 at node N1 and VN3 at node N3 are set to 0 (V), respectively; and transistors QH1-QHn of switch parts OUT1-OUTn are turned on so as to apply voltage Vsc to scan electrodes SC1-SCn. Next, transistor Q74 and Q72 are turned off and transistor Q64 is turned on so as to operate a Miller integrating circuit. Then, voltage VN3 at node N3 gently is increased toward voltage Vset after the voltage is increased by Zener voltage Vz of Zener diode D64. Since transistor Q73 as a separation switch is turned on, similar to voltage VN3 at node N3, voltage VN0 at node N0 is gently increased. Thus, since each of switch parts OUT1-OUTn outputs a voltage obtained by superimposing voltage Vsc to voltage VN0 at node N0, an inclined waveform voltage gently increasing toward voltage (Vsc+Vset) is applied to scan electrodes SC1-SCn.

At this time, transistors Q71, Q72, Q66, and Q68 connected to node N1 are all turned off. However, in this exemplary embodiment, since protective capacitor C71 is connected between node N1 and node N3, voltage VN1 at node N1 does not become indeterminate. The change of voltage VN1 at node N1 is equal to a voltage obtained by dividing the change of voltage VN3 at node N3 by the stray capacitance generated between node N1 and each power supply, the capacitance of protective capacitor C71, and stray capacitance aligned thereto. Since voltage VN3 at node N3 is equal to a voltage gently increasing toward voltage Vset, voltage VN1 at node N1 is also gently increased. Assuming that the stray capacitance is generated by a transistor, and when the capacitance value of protective capacitor C71 is denoted by Cc71 and the stray capacitance values of transistors Q71, Q72, Q66, and Q68 are denoted by Cq71, Cq72, Cq66, and Cq68, respectively, voltage VN1 at node N1 is calculated from the following equation.

$$VN1=VN0\cdot(Cq72+C71)/(Cq66+Cq68+Cq71+Cq72+Cc71)$$

Herein, assuming that the stray capacitances of transistors Q72, Q66, and Q68 are small, the following relation is satisfied.

$$VN1\approx VN0\cdot Cc71/(Cq71+Cc71)$$

It is shown that voltage VN1 at node N1 is also gently increased. However, with the work of diode D71, voltage VN1 does not exceed voltage Vsus.

Thus, when protective capacitor C71 is provided, the voltage difference (VN1−VN0) between node N1 and node N0 can be reduced, and breakdown voltage of transistor Q72 as a separation switch can be reduced.

While this inclined waveform voltage is increased, feeble initializing discharge occurs between scan electrodes SC1-SCn and sustain electrodes SU1-SUn and between scan electrodes SC1-SCn and data electrodes D1-Dm, respectively. Wall voltage is accumulated on the respective electrodes.

In the latter half part of the initializing period, positive voltage Ve1 is applied to sustain electrodes SU1-SUn and a gently reducing downward inclined waveform voltage is applied to scan electrodes SC1-SCn.

Before the downward inclined waveform voltage is applied to scan electrodes SC1-SCn, firstly, transistor Q64 is turned off. Then, transistor Q71 and transistor Q72 are turned on so as to change voltage VN0 at node N0, voltage VN1 at node N1 and voltage VN3 at node N3 to voltage Vsus, respectively. Thereafter, transistors QH1-QHn of switch parts OUT1-OUTn are turned off and transistors QL1-QLn are turned on so as to apply a voltage at node N0, that is, voltage Vsus to scan electrodes SC1-SCn. Then, transistor Q71 and transistor Q73 are turned off and transistor Q66 is turned on so as to operate a Miller integrating circuit. Then, voltage VN1 at node N1 is generally reduced to voltage Vad. Since transistor Q72 as a separation switch is turned on, similar to voltage VN1 at node N1, voltage VN0 at node N0 is gently reduced to voltage Vad. Thus, the inclined waveform voltage that is gently reduced to voltage Vad is applied to scan electrodes SC1-SCn.

At this time, transistors Q73, Q74, and Q64 connected to node N3 are all turned off. However, in this exemplary embodiment, since protective capacitor C71 is connected between node N3 and node N1, voltage VN3 at node N3 is not indeterminate. The changed portion of voltage VN3 at node N3 is equal to a voltage obtained by dividing the changed portion of voltage VN1 at node N1 by the stray capacitance generated between node N3 and each power supply, the capacitance of protective capacitor C71, and stray capacitance aligned thereto. Since voltage VN1 at node N1 is equal to a voltage gently reducing toward voltage Vad, voltage VN3 at node N3 is also gently increased. Assuming that the stray capacitance is generated by a transistor and when the capacitance value of protective capacitor C71 is denoted by Cc71 and the stray capacitance values of transistors Q73, Q74, and Q64 are respectively denoted by Cq73, Cq74, and Cq64, voltage VN3 at node N3 is calculated from the following equation:

$$VN3=(VN0-Vsus)\cdot(Cq73+Cc71)/(Cq64+Cq74+Cq73+Cc71)$$

Herein, assuming that the stray capacitances transistors Q73 and Q64 are small, the following relation is satisfied.

$$VN2\approx(VN0-Vsus)\cdot Cc71/(Cq71+Cc71)$$

It is shown that voltage VN3 at node N3 is also generally increased. However, with the work of diode D74, voltage VN1 does not become lower than 0 (V).

Thus, when protective capacitor C71 is provided, the voltage difference (VN3−VN0) between node N3 and node N0 can be reduced, and breakdown voltage of transistor Q73 as a separation switch can be reduced.

Then, while this inclined waveform voltage is reduced, feeble initializing discharge occurs again between scan electrodes SC1-SCn and sustain electrodes SU1-SUn and between scan electrodes SC1-SCn and data electrodes D1-Dm, respectively. Wall voltage on each electrode is adjusted to a value suitable for an address operation. In this exemplary embodiment, in order to make a fine adjustment of the wall voltage, immediately before the voltage applied to scan electrodes SC1-SCn reaches voltage Vad, the voltage drop is stopped.

Thus, in the initializing period, initializing discharge is generated, and wall charge necessary for the subsequent address discharge is formed on each electrode. As shown in the initializing period of the second subfield shown in FIG. 5, the first half part of the initializing period may be omitted. In this case, initializing discharge selectively occurs in a discharge cell in which sustain discharge has been carried out in the sustain period of the immediately preceding subfield.

Thus, in this exemplary embodiment, by connecting protective capacitor C71 between node N1 and node N3, in the first half part of the address period, protective capacitor C71 works as a protective capacitor for reducing the breakdown voltage of transistor Q72. Furthermore, in the latter half part of the address period, protective capacitor C71 works as a protective capacitor for reducing the breakdown voltage of transistor Q73. Thus, in this exemplary embodiment, by providing only one protective capacitor C71, the breakdown voltages of two separation switches, i.e., transistor Q72 and transistor Q73 can be reduced.

Note here that it is advantageous from the viewpoint that breakdown voltages of transistors Q72 and Q73 are reduced that when the capacitance value of protective capacitor C71 is increased, since the voltage difference (VN1−VN0) between node N1 and node V0 and the voltage difference (VN3−VN0) between node N3 and node V0 can be reduced. However, when the capacitance value of protective capacitor C71 is too large, a peak current, generated when transistors Q72 and Q73 are turned on, is increased, thus increasing the power consumption. In this exemplary embodiment, the capacitance value of protective capacitor C71 is set to in the range form 1 nF to 50 nF, for example, to 20 nF. It is desirable that this value is suitably set on the basis of the stray capacitance value of each transistor or a peak current generated when the transistors are turned on, permissible range of power consumption, and the like.

Operations in the subsequent address period and sustain period are the same as those in the first exemplary embodiment, the description thereof is omitted.

The first and second exemplary embodiments describe a configuration in which scan electrode drive circuit 143 connects the output of first waveform generating circuit 66 to node N1 and connects the output of second waveform generating circuit 64 to node N3. However, the exemplary embodiment is not necessarily limited to this configuration.

Third Exemplary Embodiment

Figure 10:
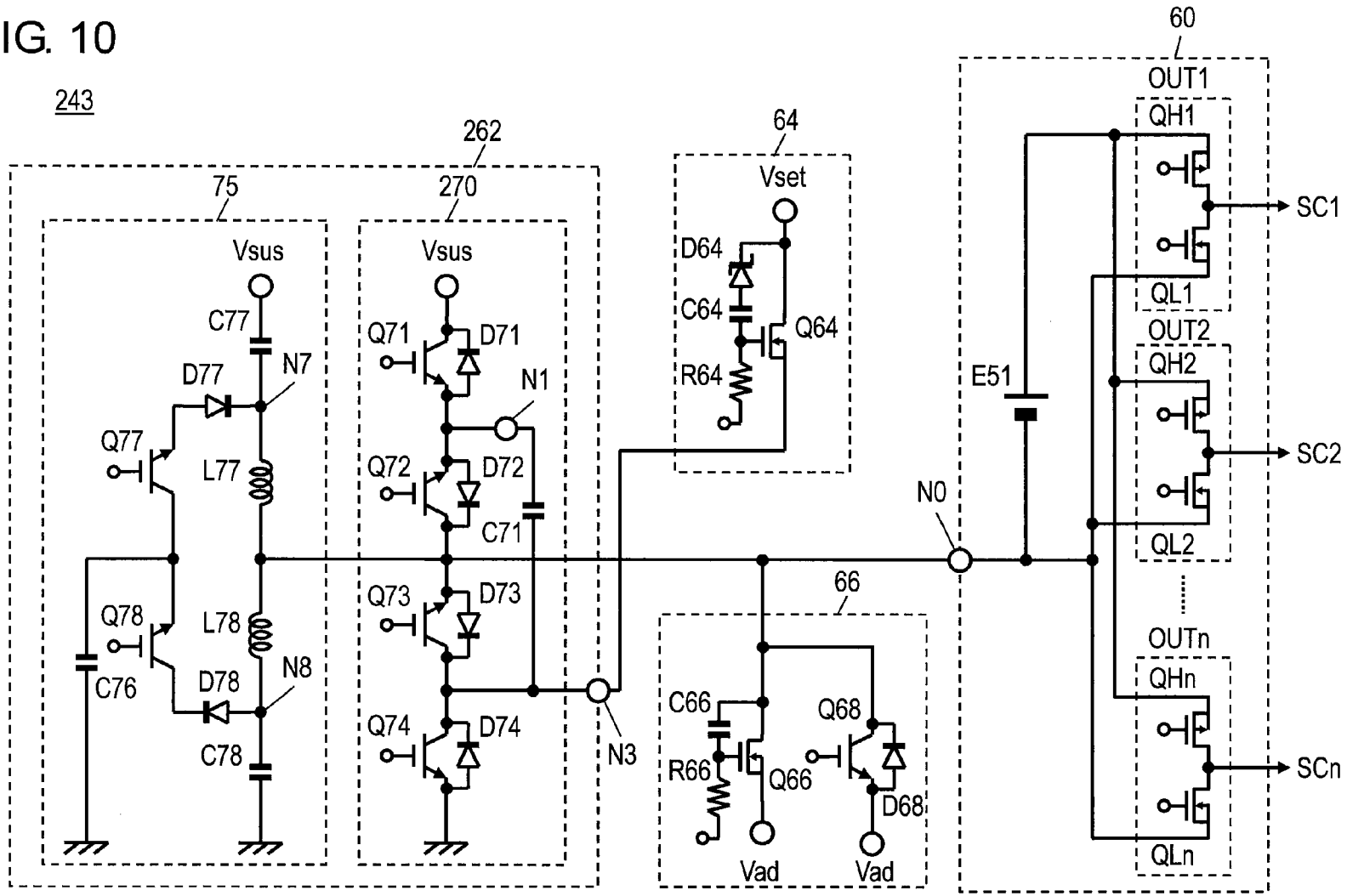
FIG. 10 is a circuit diagram showing a detail of a scan electrode drive circuit of a plasma display device in accordance with a third exemplary embodiment of the present invention.

FIG. 10 is a circuit diagram showing a detail of scan electrode drive circuit 243 of a plasma display device in accordance with a third exemplary embodiment of the present invention. Similar to scan electrode drive circuit 43 shown in FIG. 4, scan electrode drive circuit 243 includes scan pulse generating circuit 60, sustain pulse generating circuit 262, second waveform generating circuit 64, and first waveform generating circuit 66. Scan electrode drive circuit 243 in accordance with the third exemplary embodiment shown in FIG. 10 is different from scan electrode drive circuit 143 in accordance with the second exemplary embodiment shown in FIG. 8 in that the output of first waveform generating circuit 66 is connected to node N0 to which a sustain pulse from sustain pulse generating circuit 262 is output. Since other configurations are the same, the same reference numerals are given to the same configurations, and the detailed description of the configurations and operations thereof are omitted herein. Note here that the output of second waveform generating circuit 64 is connected to node N3 between second clamping switch 74 and second separation switch 73, which is the same as scan electrode drive circuit 43 in accordance with the first exemplary embodiment shown in FIG. 4 and scan electrode drive circuit 143 in accordance with the second exemplary embodiment shown in FIG. 8.

With such a configuration, as is apparent from FIGS. 6 and 9, the breakdown voltage of the transistor used in first waveform generating circuit 66 becomes higher. That is to say, since the difference between voltage Vad and voltage VN0 at node N0 is (Vsc+Vset−Vad)=430 (V) at the maximum, for example, an element having a breakdown voltage of 600 (V) must be used for transistors Q66 and Q68.

With such a configuration, similar to the first and second exemplary embodiments, switching elements included between electric power recovery capacitor C76 and scan electrode SCi are only two transistors and one diode. Furthermore, the switching elements included between the power supply of voltage Vsus and scan electrode SCi as well as between GND and scan electrode SCi are only two transistors and one diode or three transistors. Furthermore, switching elements included between each power supply of voltage Vset and voltage Vad and scan electrode SCi are also only two transistors and one diode or three transistors. In this way, also in this exemplary embodiment, the number of switching elements included in each electric current passage is made to be three or less, thereby suppressing the output impedance of scan electrode drive circuit 243.

Furthermore, similar to the first and exemplary embodiments, for example, an element having a breakdown voltage of 350 (V) can be used for transistor Q71 and diode D71. Furthermore, for example, an element having a breakdown voltage of 200 (V) can be used for transistor Q72 and diode D72. Furthermore, for example, an element having a breakdown voltage of 150 (V) can be used for transistor Q73 and diode D73. Furthermore, for example, an element having a breakdown voltage of 400 (V) can be used for transistor Q74 and diode D74.

Furthermore, for example, an element having a breakdown voltage of 300 (V) can be used for transistor Q77 and back-flow preventing diode D78, and an element having a breakdown voltage of 400 (V) can be used for transistor Q78 and back-flow preventing diode D77, respectively.

Thus, in the third exemplary embodiment, without increasing the breakdown voltage of the switching elements constituting scan electrode drive circuit 243 excluding transistors Q66 and Q68, the output impedance of scan electrode drive circuit 243 can be reduced.

Furthermore, by connecting protective capacitor C71 between node N1 between first clamping switch Q71 and first separation switch Q72 and node N3 between second clamping switch Q74 and second separation switch Q73, protective capacitor C71 works as a protective capacitor for reducing the breakdown voltage of transistor Q72 in the first half part of the address period, and protective capacitor C71 works as a protective capacitor for reducing the breakdown voltage of transistor Q73 in the latter half part of the address period. Thus, by providing only one protective capacitor C71, it is possible to reduce the breakdown voltages of two separation switches, i.e., transistors Q72 and Q73.

As mentioned above, in the plasma display device in this exemplary embodiment, the first clamping switch, the first separation switch, the second clamping switch and the second separation switch, an insulated gate bipolar transistor or a field-effect transistor can be used, respectively. That is to say, an emitter or a source of the first clamping switch and an emitter or a source of the first separation switch may be connected to each other, and a collector or a drain of the second clamping switch and a collector or a drain of the second separation switch may be connected to each other.

Furthermore, as mentioned above, in the plasma display device in this exemplary embodiment, sustain pulse generating circuit 62 includes clamping part 70 and power recovery part 75. Power recovery part 75 includes electric power recovery capacitor C76; transistor Q77 as a first recovery switch, back-flow preventing diode D77 and first recovery inductor L77, which are connected in series so as to form an electric current passage in which an electric current is allowed to flow from electric power recovery capacitor C76 to scan electrodes SC1-SCn; and transistor Q78 as a second recovery switch, back-flow preventing diode D78 and second recovery inductor L78, which are connected in series so as to form an electric current passage in which an electric current is allowed to flow from scan electrodes SC1-SCn to electric power recovery capacitor C76. Interelectrode capacitance Cp and first recovery inductor L77 or second recovery inductor L78 are allowed to LC resonance to each other, thus rising and falling the sustain pulse. A node at which back-flow preventing diode D77 and first recovery inductor L77 are connected to each other is referred to as "node N7," and a node at which back-flow preventing diode D78 and second recovery inductor L78 are connected to each other is referred to as "node N8." Furthermore, in order to suppress the ringing, power recovery part 75 includes first damper capacitor C77 connected to node N7 between the first recovery switch and first recovery inductor L77, and second damper capacitor C78 connected to node N8 between the second recovery switch and second recovery inductor L78. Power recovery part 75 suppresses ringing so that an excess voltage is not applied to back-flow preventing diode D77 and back-flow preventing diode D78.

Furthermore, as mentioned above, in the plasma display device of this exemplary embodiment, at least one of first waveform generating circuit 66 and second waveform generating circuit 64 may include a Miller integrating circuit.

Note here that specific values used in this exemplary embodiment are just examples, it is desirable that values are appropriately set to suitable values according to the property of a panel or specification of a plasma display device.

INDUSTRIAL APPLICABILITY

The present invention is useful as a plasma display device because an output impedance can be reduced without increasing the breakdown voltage of switching elements constituting a scan electrode drive circuit.

The invention claimed is:

1. A plasma display device comprising:

a plasma display panel including a scan electrode, a sustain electrode and a data electrode;

a scan pulse generating circuit for generating a scanning pulse; and a scan electrode drive circuit for generating a drive waveform to be applied to the scan electrode, the scan electrode drive circuit including:

a sustain pulse generating circuit for generating a sustain pulse to be applied to the scan electrode;

a first waveform generating circuit for reducing a voltage to be applied to the scan electrode in an initializing period; and a second waveform generating circuit for increasing a voltage to be applied to the scan electrode in the initializing period;

wherein the sustain pulse generating circuit includes:

a first clamping switch for clamping an output to a voltage at a high voltage side of a sustain power supply for generating the sustain pulse;

a first separation switch connected in series to the first clamping switch;

a second clamping switch for clamping an output to a voltage at a low voltage side of the sustain power supply; and a second separation switch connected in series to the second clamping switch;

wherein the output of the first waveform generating circuit is connected to a node to which the sustain pulse is output from the sustain pulse generating circuit, and an output of the second waveform generating circuit is connected to a node between the second clamping switch and the second separation switch, and the scan pulse generating circuit and the first clamping switch were connected through the first separation switch, and the scan pulse generating circuit and the second clamping switch were connected through the second separation switch.

2. The plasma display device of claim 1, wherein the first clamping switch, the first separation switch, the second clamping switch, and the second separation switch are an insulated gate bipolar transistor or a field-effect transistor, an emitter or a source of the first clamping switch and an emitter or a source of the first separation switch are connected, and a collector or a drain of the second clamping switch and a collector or a drain of the second separation switch are connected.

3. The plasma display device of claim 1, wherein the sustain pulse generating circuit includes:

an electric power recovery capacitor;

a first recovery switch and a first recovery inductor connected in series so as to form an electric current passage in which an electric current is allowed to flow from the electric power recovery capacitor to the scan electrode;

a second recovery switch and a second recovery inductor connected in series so as to form an electric current passage in which an electric current is allowed to flow from the scan electrode to the electric power recovery capacitor;

a first damper capacitor connected to a node between the first recovery switch and the first recovery inductor; and a second damper capacitor connected to a node between the second recovery switch and the second recovery inductor.

4. The plasma display device of claim 1, wherein at least one of the first waveform generating circuit and the second waveform generating circuit includes a Miller integrating circuit.

5. The plasma display device of claim 1, wherein a protective capacitor is connected between a node between the first clamping switch and the first separation switch, and a node between the second clamping switch and the second separation switch.

6. A plasma display device comprising:

a plasma display panel including a scan electrode, a sustain electrode and a data electrode;

a scan pulse generating circuit for generating a scanning pulse; and a scan electrode drive circuit for generating a drive waveform to be applied to the scan electrode, the scan electrode drive circuit including:

a sustain pulse generating circuit for generating a sustain pulse to be applied to the scan electrode;

a first waveform generating circuit for reducing a voltage to be applied to the scan electrode in an initializing period; and a second waveform generating circuit for increasing a voltage to be applied to the scan electrode in the initializing period;

wherein the sustain pulse generating circuit includes:

a first clamping switch for clamping an output to a voltage at a high voltage side of a sustain power supply for generating the sustain pulse;

a first separation switch connected in series to the first clamping switch;

a second clamping switch for clamping an output to a voltage at a low voltage side of the sustain power supply; and a second separation switch connected in series to the second clamping switch;

wherein an output of the first waveform generating circuit is connected to a node between the first clamping switch and the first separation switch, and an output of the second waveform generating circuit is connected to a node between the second clamping switch and the second separation switch; and the scan pulse generating circuit and the first clamping switch were connected through the first separation switch, and the scan pulse generating circuit and the second clamping switch were connected through the second separation switch.

7. The plasma display device of claim 6, wherein the sustain pulse generating circuit includes:

an electric power recovery capacitor;

a first recovery switch and a first recovery inductor connected in series so as to form an electric current passage in which an electric current is allowed to flow from the electric power recovery capacitor to the scan electrode;

a second recovery switch and a second recovery inductor connected in series so as to form an electric current passage in which an electric current is allowed to flow from the scan electrode to the electric power recovery capacitor;

a first damper capacitor connected to a node between the first recovery switch and the first recovery inductor, and a second damper capacitor connected to a node between the second recovery switch and the second recovery inductor.

8. The plasma display device of claim 6, wherein a protective capacitor is connected between a node between the first clamping switch, and the first separation switch and a node between the second clamping switch and the second separation switch.

* * * * *

UNITED STATES PATENT AND TRADEMARK OFFICE

CERTIFICATE OF CORRECTION

PATENT NO. : 8,159,487 B2
APPLICATION NO. : 12/376859
DATED : April 17, 2012
INVENTOR(S) : Fumito Kusama et al.

It is certified that error appears in the above-identified patent and that said Letters Patent is hereby corrected as shown below:

In column 9, line 45, please delete “k=1 m” and instead insert -- k=1-m --

Signed and Sealed this
Twenty-eighth Day of August, 2012

David J. Kappos

David J. Kappos
*Director of the United States Patent and Trademark Office*